United States Patent [19]

Tetzlaff

[11] Patent Number: 4,897,877

[45] Date of Patent: Jan. 30, 1990

[54] SUB-WOOFER DRIVER COMBINATION WITH DUAL VOICE COIL ARRANGEMENT

[75] Inventor: Robert J. Tetzlaff, Elgin, Ill.

[73] Assignee: Oxford Speaker Company, Chicago, Ill.

[21] Appl. No.: 50,560

[22] Filed: May 18, 1987

[51] Int. Cl.[4] ..... H04R 5/02

[52] U.S. Cl. ..... 381/24; 381/86; 381/195

[58] Field of Search ..... 381/24, 86, 195, 194

[56] References Cited

U.S. PATENT DOCUMENTS

| | | | |
|---|---|---|---|
| 1,674,934 | 6/1928 | Victoreen . | |
| 1,971,452 | 8/1934 | Herrman | 175/339 |
| 2,699,472 | 1/1955 | Olson et al. | 381/195 |
| 2,769,942 | 11/1956 | Hassan | 381/195 |
| 3,193,627 | 7/1965 | Hecht | 179/115.5 |
| 3,665,124 | 5/1972 | Sotome | 179/115.5 DV |
| 3,711,659 | 1/1973 | Bremseth | 179/115.5 VC |
| 3,796,839 | 3/1974 | Torn | 381/195 |
| 3,935,399 | 1/1976 | Lian | 179/115.5 VC |
| 4,118,605 | 10/1978 | Kobayashi | 179/115.5 VC |
| 4,132,861 | 1/1979 | Frieder, Jr. et al. | 179/1 P |
| 4,160,133 | 7/1979 | Wiik | 179/115.5 VC |
| 4,230,905 | 10/1980 | Crum et al. | 381/24 |
| 4,300,022 | 11/1981 | Hastings-James et al. | 179/115.5 DV |
| 4,357,498 | 11/1982 | Tsuchiya et al. | 381/195 |
| 4,410,768 | 10/1983 | Nakamura et al. | 179/115.5 R |
| 4,413,162 | 11/1983 | Lumsden et al. | 179/115.5 VC |
| 4,427,846 | 1/1984 | Millward | 179/115.5 VC |
| 4,539,442 | 9/1985 | Puls et al. | 179/115.5 VC |
| 4,573,189 | 2/1986 | Hall | 381/96 |
| 4,586,192 | 4/1986 | Arntson | 381/24 |

*Primary Examiner*—Forester W. Isen

*Attorney, Agent, or Firm*—Fleit, Jacobson, Cohn, Price, Holman & Stern

[57] ABSTRACT

A high-fidelity stereophonic automobile audio system has a rear speaker for each channel with a coaxial dual voice coil structure. One voice coil is optimized for full-range reproduction and is driven directly from a rear channel output of the vehicle radio. The other voice coil is optimized for sub-woofer operation and is driven through a separate sub-woofer amplifier connected to both the front and rear radio outputs of the respective channels. The system provides improved bass response in all positions of the radio fader control without the need for separate sub-woofer drivers, and other provisions. The dual voice coils may be wound on a seamless coil former for improved speaker performance.

24 Claims, 3 Drawing Sheets

SUB-WOOFER DRIVER COMBINATION WITH DUAL VOICE COIL ARRANGEMENT

BACKGROUND OF THE INVENTION

This invention relates to high-fidelity loudspeaker systems, particularly automobile loudspeaker systems, and to a novel loudspeaker structure for use therein.

In modern-day automobile stereophonic sound systems, for example, there are matching front and rear sets of loudspeakers for the respective stereophonic channels, commonly one or two loudspeaker sets. Thus, for each stereophonic channel, there may be a speaker located in the front of the automobile, typically in a door or in the dashboard, and a speaker positioned at the rear of the automobile, typically being located in the trunk space under a shelf behind the rear seat. Dependant on the design of a particular speaker, the individual speaker structure may contain combinations of high frequency, mid-range, and low frequency loudspeakers.

The most advanced systems, in order to obtain optimum sound reproduction, particularly improved bass response, presently incorporate at least one additional speaker, an ultra-low frequency range sub-woofer, along with the requisite sub-woofer amplifier and wiring. In view of the generally non-directional characteristics of a sub-woofer, it is possible to provide only a single sub-woofer for the entire stereophonic system. Still, however, particularly in the automotive environment, space and cost considerations are of significant importance.

The modern automobile typically is designed to accommodate two front and two rear speaker sets. To provide an additional speaker (the sub-woofer) generally requires substantial sheet metal and interior trim modifications to the vehicle, additional installation complexity, significant added costs, and often times a reduction of the usable trunk space and the like.

SUMMARY OF THE INVENTION

It is a primary object of the invention to provide a novel high-fidelity loudspeaker system, particularly for automobiles, which provides sound reproduction improvements at least equivalent to known systems that incorporate an additional sub-woofer, but without the need for an additional speaker location, interior trim components, and the resultant implementation drawbacks associated therewith.

Another object of the invention is to provide a novel loudspeaker structure which provides sub-woofer as well as higher frequency range functions.

Briefly stated, in fulfillment of the above and other objects, the invention provides a dynamic loudspeaker structure primarily intended for use in an automotive loudspeaker system and which incorporates two or more separate and electrically isolated voice coils, one wound over the other, conveniently on a common former, the respective coils being optimized in terms of operational characterisitics to provide sub-woofer and higher frequency range speaker reproduction, respectively. Preferably, the voice coil intended to provide higher frequency range reproduction may have a relatively short, low-mass winding, suited for high sensitivity full range reproduction, laid over or under the sub-woofer coil which may comprise a longer winding, for example, twice the length of the full range coil, to provide high linearity during high excursion operation. The full range coil may, for example, have a length equivalent to the width of the magnetic gap in which it operates, and an impedance of about 10 ohms, while the sub-woofer coil may have about a 4 ohm impedance. The full range coil may be driven directly by a radio, for example, and the sub-woofer coil may be driven by a separate sub-woofer amplifier known per se. In addition, the sub-woofer coil may be a one layer coil either consisting of multiple round wire windings with an overlapping return lead or multiple deformed round wire windings commonly referred to as ribbon, flat wire and edge wound coils. Once the maximum drive cone excursion limits are established, the sub-woofer voice coil should be designed with a winding as long as possible without risking potential mechanical strike with a rear or back plate of the speaker. The software components (cone and spider) should limit maximum excursion before the bottom of the voice coil or former is allowed to strike the rear plate.

In accordance with a further preferred feature of the invention, the dual voice coil referred to above may be wound on a seamless tubular former, for example, a seamless aluminum tube. A seamless electrically conductive former provides additional loudspeaker damping improving transient response and distortion, using any established method of measurement, as compared to conventional cylindrical formers of any type which are rolled from a sheet, thereby including a longitudinal seam, such formers including, for example, formers made of aluminum sheet, Nomex, Kapton, or paper of the same design. While the former may, for example, have a diameter of about one inch, the invention effectively applies to all voice coil sizes (diameters).

Multiple voice coil speaker structures in accordance with the invention may, advantageously, be incorporated in automobile high fidelity stereophonic sound systems to provide improved bass response without the need for separate or additional sub-woofer drivers, or provisions. Thus, one preferred two-channel automobile loudspeaker system incorporating the invention may, for example, include matched tweeter/mid-range speakers for the vehicle front doors, and matched sub-woofer/full range speakers for the rear of the automobile. The full range voice coils of the respective sub-woofer/full range may be driven by the vehicle radio and the respective sub-woofer voice coils may be driven by an additional sub-woofer amplifier, or amplifiers which may be located wherever space permits in the vehicle, such as in the trunk. The or each sub-woofer amplifier may be connected to respective front and rear radio outputs to provide operation of the sub-woofers irrespective of the positioning of the radio fader control, thereby obtaining the improved bass response even when the fader is in the front position which is a significant feature of such systems.

The use of sub-woofer/full range speakers in accordance with the invention in an automobile high-fidelity sound system offers the advantage of improved bass response without the need for an additional driver, enclosure, or other provisions. Accordingly, no sheet metal modification to a vehicle is required in order to provide the improved acoustical system enabling the system to be implemented with minimal engineering effort and manufacturing inconvenience. Further, the invention provides a retrofit facility enabling existing audio systems to be upgraded without the need for vehicle sheet metal modifications to accommodate an additional driver or other implementation provisions.

Cost savings, of course, are realized. And as an added advantage, the ability to provide two sub-woofers reduces the excursion required by each, as compared to a single sub-woofer driver, to obtain the same sound pressure level resulting in improved linearity.

Additional features and advantages of the invention will become apparent from the ensuing description and claims read in conjunction with the accompanying drawings.

DESCRIPTION OF PREFERRED EMBODIMENTS

Figure 1A:
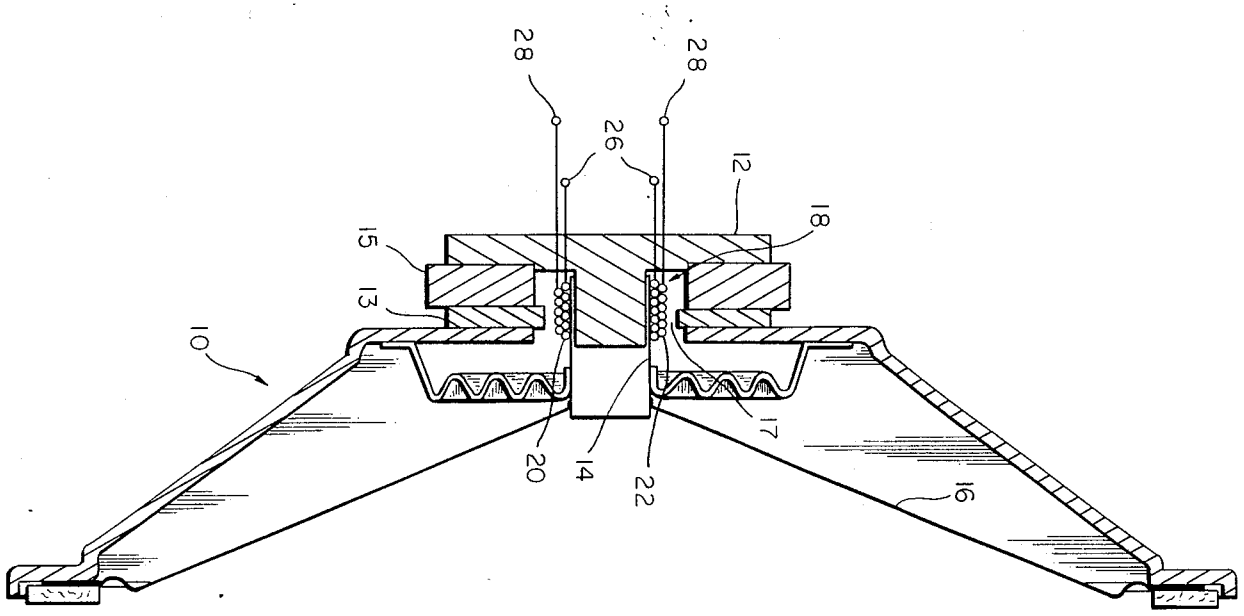
FIGS. 1*a* and 1*b* are diagramatic sectional views of alternative forms of loudspeaker structure in accordance with the invention.
Figure 1B:
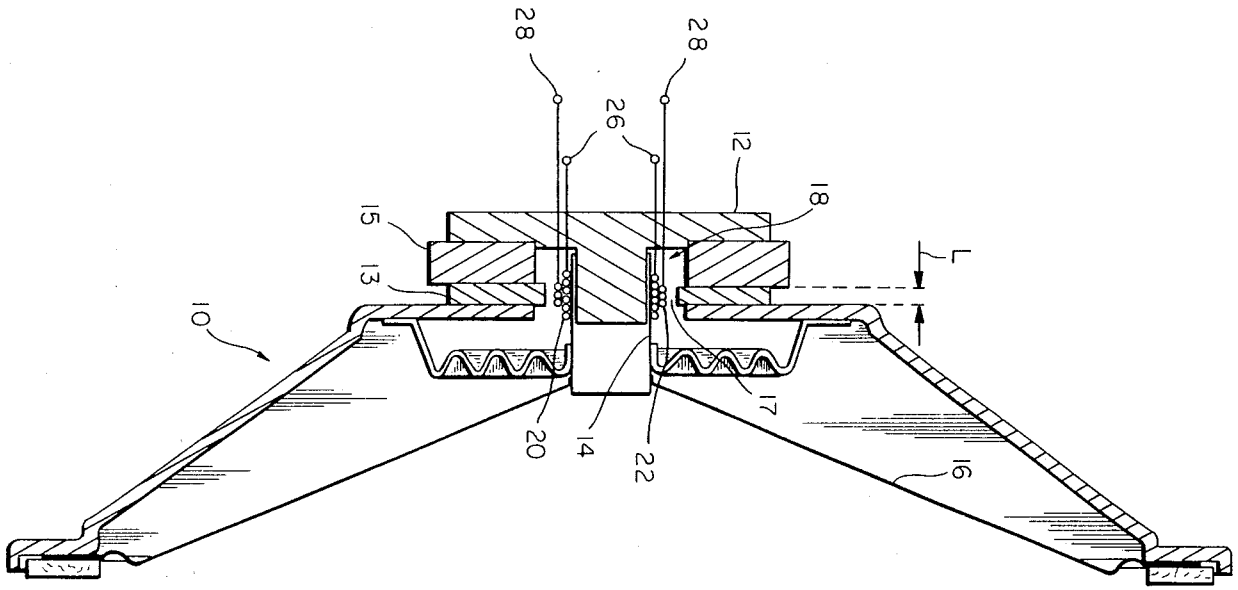

Referring initially to FIGS. 1*a* and 1*b*, there is shown in each case and in semi-diagramatic form, a dynamic sub-woofer/full range loudspeaker structure 10 in accordance with the invention, including a magnetic circuit comprising highly permeable structures 12 and 13, permanent magnet 15, and air gap 17. A coil former 14 is located axially in the air gap 17 for driving a diaphragm cone 16 responsive to fluctuating electric signals received by a voice coil assembly 18 wound on the coil former.

Coil former 14 may be formed from any conventional type of former material, such as aluminum, Nomex, Kapton or paper. One preferred type of former, however, comprises a length of seamless aluminum tubing, for example, of about one inch in diameter, which has been cut from a long length of such tubing, and which is connected to the diaphragm cone in a known manner. An electrically conductive former, such as aluminum, provides enhanced loudspeaker damping, improving transient response and distortion. A seamless electrically conductive former improves these characteristics to a great extent.

In accordance with the invention, the voice coil assembly 18 comprises electrically isolated inner and outer voice coils 20, 22, the inner voice coil 20 constituting an ultra low-range sub-woofer voice coil, and the outer voice coil 22 constituting a substantially full range voice coil. To this end, as shown in FIG. 1*b*, voice coil 20 is preferably of extended length to provide characteristics desirable for sub-woofer functioning, while voice coil 22 is of shorter length for high sensitivity full-range reproduction. Coil 22 may, for example, have an impedance of 10 ohms and a width comparable to the length L of the magnetic air gap. Coil 20 may have an impedance of 4 ohms and a length approximately double that of coil 22. Each of the coils may comprise single or multiple layers, and the coils may be separated by suitable insulation. For example, preferably the sub-woofer voice coil 20 is a single layer whereas the full range voice coil 22 is a two-layer winding. Preferably, the length of the two-layer winding 22 is one-half the length of the single-layer winding 20. Alternatively, as shown in FIG. 1*a* the winding lengths may be equal. Similarly, both the full range voice coil 22 and the sub-woofer voice coil 20 may each be a two-layer winding, with lengths equal or unequal. Unequal winding lengths are preferred to minimize electrical coupling between the windings. The sub-woofer voice coil 20 may have input leads 26 for connection to a sub-woofer amplifier of known type, and the full range voice coil 22 may have input leads 28 for connection to a full range amplifier, such as in an automobile radio.

While the use of a seamless coil former 14 as described, inter alia increases damping which improves transient response and limits distortion caused, for example, by the full range voice coil 22 moving outside of the magnetic gap, the invention is not limited thereto. As indicated, other coil former structures can be used, and coil assembly 18 can even be designed to be self-supporting dispensing entirely with a coil former.

Figure 2:
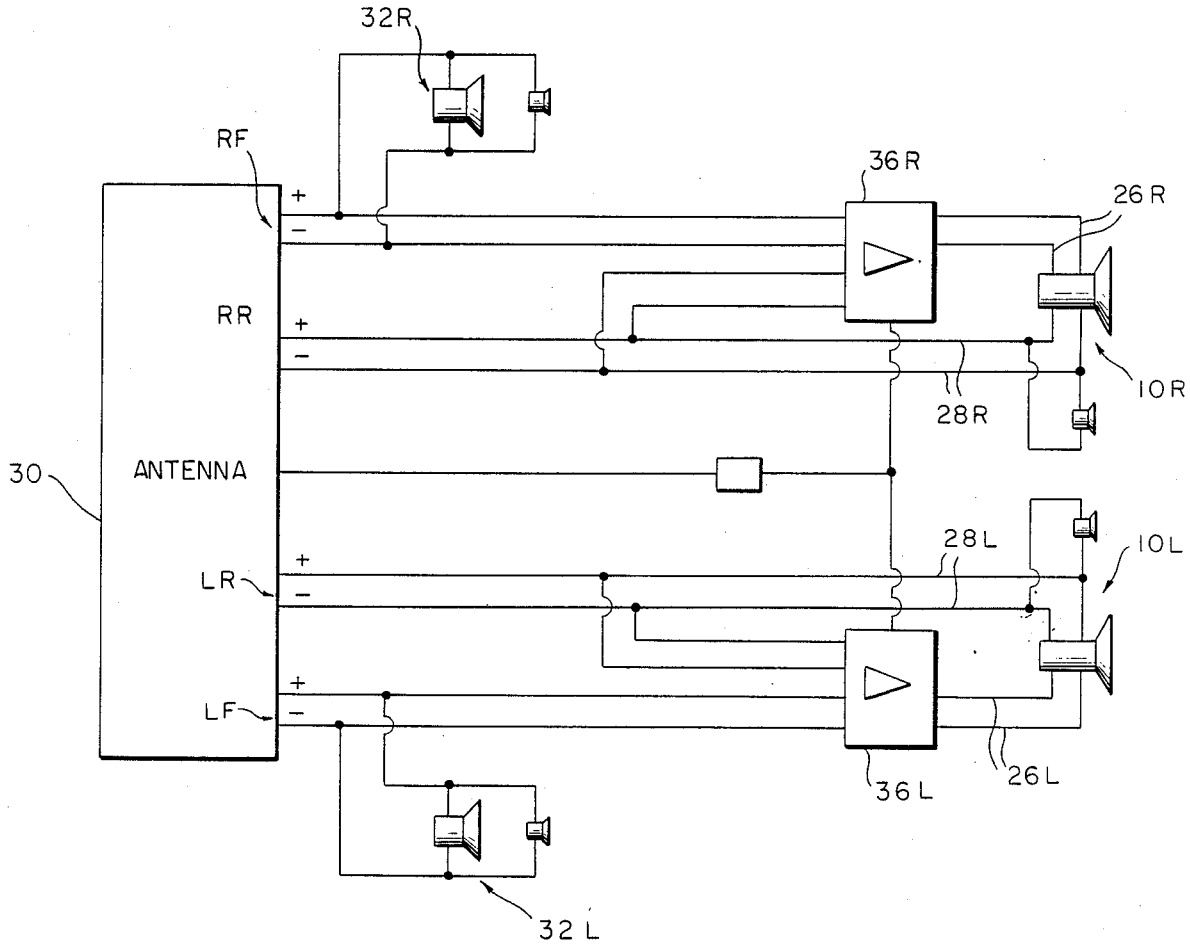
FIG. 2 is a wiring diagram for an automobile stereophonic sound system incorporating loudspeakers of the type illustrated in FIGS. 1*a* and 1*b*.

FIG. 2 is a wiring diagram for an automobile 2-channel stereophonic sound system, incorporating inter alia, respective left and right hand full range/sub-woofer loudspeaker structures 10L, 10R of the kind described above.

The wiring diagram shows a conventional stereophonic 2-channel radio 30, with a left front output LF, a left rear output LR, a right front output RF, and a right rear output RR. Conventional matching left and right front speakers assemblies 32L, 32R, which may include tweeter and mid-range speaker combinations, are connected to the respective left and right front radio outputs. The assemblies 32L and 32R may be housed in the left and right hand front doors of an automobile. Inputs 28L and 28R for the full range voice coils of speakers 10L and 10R (corresponding to voice coil 22 in FIG. 1*a* or 1*b*) are connected directly to the respective left rear and right rear radio outputs. Inputs 26L and 26R for the sub-woofer voice coils of speakers 10L and 10R (corresponding to voice coil 20 in FIG. 1*a* or 1*b*) on the other hand, are connected respectively to separate sub-woofer amplifiers 36L, 36R. It will be noted that the sub-woofer amplifiers are connected to both the front and rear radio outputs for the respective channels, so that the sub-woofer functions of speakers 10L and 10R will operate irrespective of the front to rear positioning of the radio fader control. A suitable mixing network would be required to enable the front and rear radio outputs to drive each input of the sub-woofer amplifiers. This feature of the system is of importance in obtaining enhanced bass response in all fader positions.

The left and right-hand full range/sub-woofer speakers 10L, 10R, may be housed in suitable speaker enclosures in the rear vehicle shelf in like manner to existing systems employing two rear speaker enclosures, and hence involving substantially no vehicle sheet metal modification to accommodate same. Amplifiers 36L, 36R may be accommodated wherever space permits, as in the vehicle trunk. Accordingly, the system can be fitted to new vehicles or can be retrofitted to vehicles with existing speaker systems as an enhancement for existing systems with substantially no vehicle modifications.

In a modification of the loudspeaker system described above with reference to FIG. 2, a single sub-woofer amplifier may be used (in place of amplifiers 36L, 36R) to drive both of the sub-woofer voice coils, the single amplifier preferably being connected to both the front and rear radio outputs to obtain similar characteristics to the system using both sub-woofer amplifiers.

It is evident that the invention provides a facility for improving sound reproduction within a vehicle, particularly bass response, without increasing the number of speakers in the vehicle and provisions to implement their existence. The invention also offers advantages in the use of existing trunk speaker covers, broad band equalization flexibility, and substantially no decrease in vehicle space compared with known systems.

While only the preferred embodiments of the invention have been described herein in detail, the invention is not limited thereby, and modifications can be made within the scope of the attached claims. More particularly as far as the actual speaker structure of the invention is concerned, this is considered applicable to substantially any size of speaker. The structure may be incorporated into woofer, mid-range, dual cone, three-way or four-way speakers, and any suitable impedance can be designed into the respective coils. Additionally, many variations can be made into the coil structures. The subwoofer coil can be wound either over or under the lighter frequency coil. Multiple separate coils may be wound and then connected to obtain similar results. The subwoofer coil can be of equal length to or longer than the higher frequency coil, although a double-length single layer subwoofer coil as previously described, is preferred for optimum balance of the performance parameters. Moreover, different size magnets and voice coils can be used, for example, 10, 15 or 30 oz. magnets and voice coils of 1 inch or 1 and ½ inch diameter.

What is claimed is:

1. In a vehicle sound system including in combination a radio and plural loudspeaker enclosures together containing a combination of speakers covering a range of audio frequencies, the improvement wherein at least one of said enclosures includes a dual voice coil dynamic loudspeaker structure having a diaphragm, a coil former operatively connected to the diaphragm and first and second electrically isolated voice coils wound coaxially on the coil former one over the other for driving the diaphragm, the first voice coil being connected for ultra-low frequency response, and the second voice coil being connected for higher frequency response, the first coil being connected to a radio output through an ultra-low frequency sub-woofer amplifier, and the second voice coil being connected directly to a radio output.

2. The combination as defined in claim 1, wherein the radio has front and rear outputs and the first voice coil is connected to each of the front and rear outputs through said sub-woofer amplifier.

3. The combination as defined in claim 2, wherein the radio has left and right steriophonic channels, each with respective front and rear outputs and wherein each channel is provided with a dual voice coil loudspeaker structure and sub-woofer amplifier.

4. The combination as defined in claim 3, wherein the dual voice coil structures are housed in rear speaker enclosures, and the system includes front speaker enclosures with loudspeaker structures connected to the front outputs of the respective radio channels.

5. The combination as defined in claim 1, wherein the first voice coil is longer than the second voice coil.

6. A loudspeaker system for use with a multi-channel stereophonic vehicle radio having front and rear outputs for each channel, the system including matching front loudspeaker structures for the respective channels, means for connecting the respective front loudspeaker structures to the respective front radio outputs, matching dual voice coil dynamic rear loudspeaker structures for the respective channels, each rear loudspeaker structure comprising a diaphragm, a coil former operatively connected to the diaphragm and electrically isolated voice coils coaxially wound on the coil former one over the other for driving the diaphragm, the first voice coil being connected for ultra-low frequency sub-woofer response and the second voice coil being connected for response at least in a higher frequency range than the first voice coil, ultra-low frequency sub-woofer amplifier means for the respective first voice coils, means for connecting the respective first voice coils to both the front and rear radio outputs for the respective channels through the sub-woofer amplifier means, and means for connecting the respective second voice coils directly to the rear radio outputs for the respective channels.

7. The loudspeaker system as defined in claim 6, wherein the first voice coil of each rear loudspeaker structure is a relatively long coil, and the second voice coil of each rear loudspeaker structure is a relatively short coil wound over the first voice coil.

8. The loudspeaker system as defined in claim 7, wherein each rear loudspeaker structure has a magnetic air gap of comparable length to the width of the second voice coil, and wherein the first voice coil is about twice the length of the second voice coil.

9. The loudspeaker system as defined in claim 7, wherein the coil former of each loudspeaker structure comprises a seamless tubular coil former.

10. The loudspeaker system as defined in claim 9, wherein each coil former comprises a length of seamless aluminum tubing.

11. In a dynamic loudspeaker structure including the combination of a magnetic circuit and a voice coil assembly for driving a loudspeaker diaphragm responsive to fluctuations in electrical input to the voice coil assembly, the improvement wherein the voice coil assembly comprises a first voice coil connected for ultra-low frequency sub-woofer response, a second voice coil connected for higher frequency response, separate input connections for the respective coils, and a coil former operatively connected with the diaphragm and on which both of said coils are wound coaxially, one over the other, the coils being electrically isolated one from another.

12. The improvement as defined in claim 11 wherein the first voice coil is longer than the second voice coil.

13. The improvement as defined in claim 12, wherein the second voice coil is wound over the first voice coil.

14. The improvement as defined in claim 12, wherein the magnetic circuit has a magnetic gap substantially corresponding in length to the width of the second voice coil, and wherein the first voice coil has a length about twice that of the second voice coil.

15. The improvement as defined in claim 14, wherein the coil former comprises a length of seamless tubing.

16. The improvement as defined in claim 11, wherein the second voice coil is adapted for substantially full frequency range response.

17. The improvement as defined in claim 11 wherein the coil former comprises a length of seamless aluminum tubing.

18. The improvement as defined in claim 11, wherein the impedance of said first voice coil is about 4 ohms and the impedance of said second voice coil is about 10 ohms.

19. In a high-fidelity sound system, the combination comprising a dual voice coil dynamic loudspeaker structure having a diaphragm, a coil former operatively connected to the diaphragm, and first and second electrically isolated coils wound coaxially one over the other on the coil former for driving the diaphragm, the first voice coil being connected for ultra-low frequency response, the second being voice coil being connected for higher frequency response, and separate amplifier input means for the respective voice coils including an ultra-low frequency sub-woofer amplifier for the first voice coil.

20. The combination as defined in claim 19, wherein the former is a seamless aluminum former.

21. The combination as defined in claim 19, wherein the first voice coil is connected to a radio output through said sub-woofer amplifier and the second voice coil is connected directly to the radio output.

22. The combination as defined in claim 19, wherein the first voice coil is longer than the second voice coil.

23. The combination as defined in claim 22, wherein the second voice coil corresponds in width to the length of a magnetic gap of the loudspeaker and the first voice coil is about two times said length.

24. The combination as defined in claim 23, wherein the first voice coil has an impedance of about 4 ohm. and the second voice coil has an impedance of about 10 ohm.

* * * * *